United States Patent [19]

Ponjee et al.

[11] Patent Number: 4,639,382

[45] Date of Patent: Jan. 27, 1987

[54] METHOD OF PROVIDING A METAL MIRROR ON A SURFACE MANUFACTURED FROM AN ACRYLATE SYNTHETIC RESIN OR A METHACRYLATE SYNTHETIC RESIN

[75] Inventors: Johannes J. Ponjee; Christiaan J. A. Verwijlen, both of Eindhoven, Netherlands

[73] Assignee: U.S. Philips Corporation, New York, N.Y.

[21] Appl. No.: 436,535

[22] Filed: Oct. 25, 1982

[30] Foreign Application Priority Data

Jul. 14, 1982 [NL] Netherlands ..... 8202842

[51] Int. Cl.[4] ..... B05D 5/06

[52] U.S. Cl. ..... 427/162; 427/164; 427/322; 427/443.1

[58] Field of Search ..... 427/162, 164; 427/322, 427/443.1

[56] References Cited

U.S. PATENT DOCUMENTS

| | | | |
|---|---|---|---|
| 2,214,646 | 9/1940 | Walker | 427/322 |
| 2,273,613 | 2/1942 | Bartoe | 427/322 |
| 2,303,871 | 12/1942 | Walker | 427/322 |
| 3,094,430 | 6/1963 | Skwierinski | 427/164 |

*Primary Examiner*—Sadie L. Childs

*Attorney, Agent, or Firm*—Norman N. Spain

[57] ABSTRACT

A method of providing a metal mirror on an article of acrylate or methacrylate synthetic resin in which the surface to be metallized is treated with a solution of tannin in a mixture of water and an organic solvent and the treated surface is then provided with a metal mirror by using an electroless metallization process.

2 Claims, No Drawings

METHOD OF PROVIDING A METAL MIRROR ON A SURFACE MANUFACTURED FROM AN ACRYLATE SYNTHETIC RESIN OR A METHACRYLATE SYNTHETIC RESIN

The invention relates to a method of providing a metal mirror on an article of which at least the surface on which the metal mirror is provided is manufactured from an acrylate synthetic resin or a methacrylate synthetic resin.

It is known to provide articles of synthetic resin with a metal mirror by using an electroless metallization process. For this purpose, the surface to be metallized is treated with an aqueous metal salt solution, for example, an aqueous ammoniacal silver salt solution, and subsequently or simultaneously with a reducing agent for the metal salt, metal atoms depositing on the surface.

An interesting method of electroless metallization is the so-called aerosol metallization in which the metal salt solution and the reducing agent are simultaneously atomized on the surface of the article to be metallized. For further details of this method reference is made to "The technology of aerosol plate" by Donald J. Levy in Technical Proceedings 51st Annual Convention American Electroplaters' Society, June 14–18, St. Louis, 1964, pp. 139–149.

It is stated on page 141, left column of this literature reference that upon metallizing synthetic resins the comparatively slightly polar or non-polar surface must first be treated chemically or mechanically and must then be sensitized with a reducing agent, for example, $SnCl_2$. The reduction agent initiates and accelerates the deposition of metal atoms, a first monolayer of deposited metal being formed. Various chemical treatment agents are summarized in Table II on page 140 of the above-mentioned literature reference.

However, the bonding of a metal layer provided by electroless deposition on non-polar or slightly-polar synthetic resins still remains a problem. In "The technology of aerosol plating" it is noted in this respect on page 141, left column, that the chemical forces between metal layers and synthetic resin surface are usually very weak and that a considerable improvement of the bonding occurs if the synthetic resin surface is roughened.

A method of providing a metal mirror, in particular a silver mirror, on an acrylate synthetic resin is known from U.S. Pat. No. 3,094,430. For this purpose the surface to be coated with silver is first polished, by which means all scratches are removed, and is then treated with a solution of tannin in water. The surface thus treated is silver-plated by using an ammoniacal silver nitrate solution which is provided with a reduction agent. Thus, in this case also a mechanical treatment of the surface to be metallized takes place. A sensitizing treatment with $SnCl_2$ is not used.

Applicants have carried out experiments in which an article of polymethylmethacrylate was treated with a solution of tannin (cq. tannic acid) in water and was then provided with an electroless plated layer of silver. The silver layer did not adhere to the surface of synthetic resin. Some bonding could be obtained only with a very prolonged treatment of a few hours with the solution of tannin in water. The resulting bond was unsatisfactory.

It is the object of the present invention to provide a method of providing a metal mirror on a surface of acrylate synthetic resin or methacrylate synthetic resin, in which the surface is not treated mechanically or etched chemically, and nevertheless an excellent bond is obtained between the surface of synthetic resin and the metal layer.

According to the invention this object is achieved by means of the method mentioned in the opening paragraph and which is characterized in that the surface is treated with a solution of tannin in a mixture of water and a water-miscible organic solvent, and a metal mirror is then provided on the treated surface by using an electroless metallization process.

The bonding of the metal mirror to the treated surface is excellent. The surface of acrylate synthetic resin or methacrylate synthetic resin is not etched by the treatment with the mixture of water and organic solvent, i.e. the structure or texture of the surface is maintained. Particularly no cloudiness of the transparent acrylate or methacrylate synthetic resin occurs.

The substance tannin is a pentadigalloyl glucose compound which is also known as tannic acid.

The treatment with the solution of tannin can take place by dipping the article in the solution or by atomizing or spraying the solution over the surface to be treated. The treatment time is short and is, for example, from a few seconds to a few minutes. The concentration of tannin in the solution is not restricted to narrow limits. Good results are already achieved with comparatively small concentrations of tannin such as a concentration of 0.1 to 10 g of tannin per liter of solution.

In a preferred embodiment of the method in accordance with the invention, the surface to be metallized is treated with a solution of tannin in a mixture of water and a water-miscible organic acid, alcohol, ether, ketone or ester.

The concentration of the organic solvent in the mixture of water and organic solvent may vary within wide limits, for example, from 2% by volume up to the saturation concentration. A suitable concentration is from 5 to 50% by volume.

After the treatment with the solution of tannin, an electroless plated metal mirror is provided, for example an Ag-layer or a copper layer. For this purpose, first of all the surface to be metallized is treated with a sensitizing solution. In the case of providing an Ag-layer, a sensitizing solution is used on the basis of an aqueous, acid reacting $SnCl_2$ solution. The surface to be metallized can be dipped in the $SnCl_2$ solution or be atomized with the $SnCl_2$ solution. The treatment time is from a few seconds to at most one minute. The excess of the $SnCl_2$ solution is removed by rinsing with water. The surface to be metallized is then treated with the actual metallization solutions, more particularly with a metal salt solution such as an ammoniacal silver nitrate solution and an aqueous reducing agent solution. A suitable reducing agent is, for example, formaldehyde, optionally in combination with a sugar, for example, sodium gluconate. Examples of other useful reducing agents are hydrazine sulphate, hydroxyethyl hydrazine, glyoxale and triethanol amine. The metallization solutions are preferably provided according to the already mentioned aerosol metallization process in which the metal salt solution and the reducing agent solution are simultaneously atomized on the surface to be metallized.

The electroless plated metal layer, for example an Ag-layer, can be provided with a further metal layer provided according to an electroplating process, for example electrolytically. For example, the thickness of an electroless plated silver layer, and consequently the strength of the layer, can be increased by providing thereon further Ag-layers or, if desired, a layer of another metal, for example, copper. The additional metal layer, for example, a copper layer, may be provided electrolytically, by depositing Cu on the electroless plated silver layer which serves as cathode in an electrolysis bath which contains, for example, an acid copper sulphate solution. It is also possible to provide copper by electroless plating on the silver layer, for example, according to the already mentioned aerosol metallization process, in which an acid copper sulphate solution and a reducing agent such as an aqueous dispersion of Zn-dust are simultaneously atomized over the silver layer.

A copper mirror can also very readily be provided as follows. The surface, treated with the tannin solution, is rinsed with water and sensitized with an acid-reacting $SnCl_2$ solution. The thus sensitized surface is treated with an aqueous ammoniacal silver salt solution in which the $Sn^{2+}$ ions present at the surface are exchanged for Ag which is formed according to the reaction $Sn^{2}++2Ag^{+}\rightarrow 2Ag+Sn^{4+}$. The resulting surface which comprises a monolayer of Ag is then provided with a copper layer by using an ammoniacal cuprous salt solution and an acid. This process is known as a disproportioning process and is described inter alia in Technical Proceedings 51st Annual Convention of the American Electroplaters' Society, p. 147 right column, and in German Offenlegungsschrift No. 2,527,096.

The method of the invention is particularly suitable for providing a metal mirror on a surface of acrylate or methacrylate synthetic resin which has a fine structure which is to be maintained. This applies in particular to the providing of a metal mirror on an optically readable information disk, the so-called VLP (Video Long Play) and ALP (Audio Long Play) disks. An optically readable information disk comprises on one or both surfaces an information track of information areas situated alternately at a higher level and at a lower level. The areas have very small dimensions in which the difference in level is 0.1–0.2 μm and the length of an area is approximately 0.3–3 μm. The disk is manufactured from polymethylmethacrylate or from an acrylate synthetic resin. An acrylate synthetic resin is obtained by polymerization, for example, by the use of UV light, of acrylate monomers such as alkylacrylates, for example ethyl hexyl acrylate, alkanediol diacrylates, for example hexanediol diacrylate, alkeneglycol diacrylates, for example tripropyleneglycol diacrylate and triacrylates, for example trimethylolpropane triacrylate. The disk may have a laminated structure of a carrier plate of for example polymethyl methacrylate which is covered on one side with a layer of an acrylate synthetic resin in which the information track is provided. On the side of the information track the disk is covered with a metal layer, particularly a silver layer. The metal layer must follow the contours of the information track very accurately and be firmly bonded to the substratum of synthetic resin. The difference in level between the information areas must be maintained during and after providing the metal layer, because this difference is decisive of the quality of the reproduction (reading) of the stored information. Moreover, no cloudiness of the synthetic resin in the area of the synthetic resin-metal interface should occur while providing the metal layer. These requirements are satisfied if the metal layer is provided according to the method of the invention.

The invention will now be described in greater detail by means of the following specific example.

SPECIFIC EXAMPLE

A VLP-disk is dipped for one minute in a solution of tannin in a mixture of water and an organic solvent. The VLP-disk is manufactured from polymethylmethacrylate, has a thickness of 1.2 mm and a diameter of 30 cm. On one side the disk has a spiral-like information track which has a crenellated profile of information areas situated alternately at a higher level and at a lower level. The level difference is 0.12 μm. The length of the areas varies from 0.3 to 3 μm.

The organic solvent used is recorded in column 1 of the following table. The composition of the solution is recorded in column 2 of the table. The tannin concentration in the solution is recorded in column 3. After dipping in the tannin solution the disk is rinsed with water. The surface of the disk which comprises the information track is sensitized with an aqueous $SnCl_2$ solution. For this purpose the surface is sprayed with an aqueous $SnCl_2$ solution which contains per liter 0.1 g of $SnCl_2$ and 0.1 ml of concentrated HCl. The treatment time is 12 seonds. The surface is then silver-plated in the usual manner, preferably according to the aerosol (atomizing) process in which an aqueous silver salt solution, for example a solution of $AgNO_3$ and $NH_4OH$ in water, and an aqueous reducing agent solution, for example, a solution of formalin and if desired sodium gluconate in water, are atomized simultaneously on the surface. This process as well as the metallization solutions and reducing agent solutions used are described, for example, in the above mentioned literature reference "The technology of aerosol plating".

The bonding of the thus electroless plated silver layer on the underlying layer of polymethylmethacrylate was tested according to the so-called diamond scratching test (DIN 53151). According to this standard test, twelve scratches are provided in the surface of the metal layer, which scratches extend throughout the thickness of the metal layer. The pattern of scratches comprises 6 parallel scratches at a mutual distance of 1 mm which are crossed at right angles also by 6 parallel scratches at a mutual distance of 1 mm, so that the pattern of scratches comprises 25 areas of 1 $mm^2$. An adhesive strip (cellotape) is pressed on the pattern of scratches and is then pulled off the surface. The extent of bonding is expressed in digits 0–5, in which:

0=optimum bonding, 0 areas come off
1=good bonding; 1–5 areas come off
2=reasonable bonding; 6–10 areas come off
3=insufficient bonding; 11–15 areas come off
4=poor bonding; 16–20 areas come off
5=no bonding; 21–25 areas come off.

The results of the diamond scratching test applied to the above-mentioned silver layer are recorded in column 4 of the table. The results of a comparative experiment are also recorded in the table. According to this test the disk of polymethylmethacrylate is treated with an aqueous solution of tannin which comprises no organic solvent. If the disk is treated with only an organic solvent containing no water, cracks are formed in the polymethylmethacrylate as a result of the stresses present in the PMMA resulting from the manufacturing process, for example injection moulding, in which high temperatures and pressures are used.

The above-mentioned experiments have also been carried out with a VLP (Video Long Play) disk having a laminated structure. The disk comprises a carrier plate of polymethylmethacrylate which on one side has a light-cured acrylate synthetic resin in which the information track is provided. The acrylate synthetic resin was obtained by curing a monomer mixture of the following composition with UV light:

75 wt.% tripropyleneglycoldiacrylate 10 wt.% trimethylolpropanetriacrylate 29 wt.% N-vinylpyrrolidone 4wt.% initiator.

After the above-described treatment with a solution of tannin a mixture of water and an organic solvent, the acrylate synthetic resin was provided with an Ag-layer in the manner described above. The diamond scratching test demonstrated a good bonding of the Ag-layer to the acrylate synthetic resin (bonding value 0).

The optically readable information disks (VLP-disks) described hereinbefore and having an Ag-layer on the side of the information track, may be provided, if desired, with a copper layer by simultaneously atomizing the following liquids on the silver layer.

Liquid 1:

20 l of water 50 g of zinc dust 100 g of dispersion agent (type Ermax Suspens Concentrate)

Liquid 2:

20 l of water 50 g of $CuSO_4.5aq.$ 40 g of $H_2SO_4$ (96%)

TABLE

| organic solvent | composition of solution in vol. % water | org. solvent | tannin conc. in g/l | bonding |
|---|---|---|---|---|
| methylglycolacetate | 70–90 | 10–30 | 4.3–5.5 | 0 |
| acetone | 45–90 | 10–55 | 2.7–5.5 | 0 |
| acetic acid | 55–90 | 19–45 | 3.3–5.5 | 0 |
| methanol | 45–70 | 30–55 | 2.7–4.3 | 0 |
| ethanol | 40–85 | 15–60 | 2.3–5.0 | 0 |
| monoethylglycolether | 35–45 | 55–65 | 2.1–2.7 | 0 |
| isopropanol | 50–85 | 15–50 | 3.0–5.0 | 0 |
| methylethylketone | 85–90 | 10–15 | 5.0–5.5 | 0 |
| ethyleneglycolmonoethyl-ether | 30 | 70 | 2.0 | 0 |
| 2-butoxyethylacetate | 98 | 2 | 6.0 | 0 |
| mellitic acid | 45–90 | 10–55 | 2.7–5.5 | 0 |
| ethylglycolacetate | 95 | 5 | 3.0 | 0 |
| 2-butanol | 75 | 25 | 3.0 | 0 |
| 2-ethoxyethanol | 75 | 25 | 3.0 | 0 |
| cyclohexanone | saturated solution | | 3.0 | 0 |
| — | 100 | 0 | 3.0 | 5 |

What is claimed is:

1. A method of providing a metal mirror on an article of which at least the surface on which the metal mirror is to be provided is formed of an acrylate synthetic resin or a methacrylate synthetic resin, characterized in that said surface is treated with a solution of tannin in a mixture of water and from 2% by volume up to the saturation concentration of a water-miscible organic solvent selected from the group consisting of water-miscible organic acids, alcohols, ethers, ketones and esters, and a metal mirror is then provided on said treated surface by use of an electroless metallization process.

2. The method of claim 1 wherein the concentration of the organic solvent in the mixture is from 5% by volume to 50% by volume.

* * * * *